US007604457B2

(12) United States Patent
Xu

(10) Patent No.: US 7,604,457 B2
(45) Date of Patent: Oct. 20, 2009

(54) VOLUTE FOR A CENTRIFUGAL COMPRESSOR

(75) Inventor: Cheng Xu, Huntersville, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 451 days.

(21) Appl. No.: 11/531,294

(22) Filed: Sep. 13, 2006

(65) Prior Publication Data

US 2007/0059168 A1 Mar. 15, 2007

Related U.S. Application Data

(60) Provisional application No. 60/716,599, filed on Sep. 13, 2005.

(51) Int. Cl.
*F04D 29/44* (2006.01)

(52) U.S. Cl. ..... 415/206; 415/211.2

(58) Field of Classification Search ..... 415/204, 415/206, 211.2, 214.1, 225; 417/423.14
See application file for complete search history.

(56) References Cited

U.S. PATENT DOCUMENTS

| | | | | | |
|---|---|---|---|---|---|
| 2,176,324 | A | * | 10/1939 | Bretzlaff et al. | 415/211.1 |
| 4,844,621 | A | | 7/1989 | Umemura et al. | |
| 4,900,225 | A | | 2/1990 | Wulf et al. | |
| 5,030,062 | A | * | 7/1991 | Sutton | 415/204 |
| 5,069,599 | A | | 12/1991 | Carretta | |
| 5,266,003 | A | * | 11/1993 | Warren | 415/208.3 |
| 5,624,229 | A | | 4/1997 | Kotzur et al. | |
| 6,193,463 | B1 | * | 2/2001 | Adeff et al. | 415/196 |
| 6,210,109 | B1 | * | 4/2001 | Will et al. | 415/204 |
| 6,742,989 | B2 | | 6/2004 | Osako et al. | |

FOREIGN PATENT DOCUMENTS

| | | |
|---|---|---|
| BE | 491054 | 9/1949 |
| CH | 286975 | 11/1952 |
| DE | 3926152 | 1/1991 |
| EP | 0570955 | 11/1993 |
| GB | 1199158 | 7/1970 |
| WO | WO 01/00996 | 1/2001 |

OTHER PUBLICATIONS

43rd AIAA Aerospace sciences Meeting and Exhibit, "Numerical Investigations of Volute Performance Due to Tongue Geometry," Cheng Xu, Michael Muller, Wen Jeng Chen, Jan. 10-13, 2005.

* cited by examiner

*Primary Examiner*—Ninh H Nguyen
(74) *Attorney, Agent, or Firm*—Michael Best & Friedrich LLP

(57) ABSTRACT

A volute for use in a centrifugal compressor that includes an impeller. The volute includes a housing defining a central aperture, an inlet channel, and a fluid collecting channel. The central aperture is adapted to receive the impeller such that the impeller discharges a fluid to the inlet channel. The inlet channel directs the flow to the collecting channel. A discharge portion is coupled to the housing and includes a discharge passage in fluid communication with the collecting channel to discharge the fluid. A tongue portion is disposed between the collecting channel and the discharge portion. The tongue is operable to separate the fluid into a first flow that flows through the collecting channel and a second flow that flows through the discharge passage.

25 Claims, 6 Drawing Sheets

VOLUTE FOR A CENTRIFUGAL COMPRESSOR

RELATED APPLICATION DATA

This application claims benefit under 35 U.S.C. Section 119(e) of U.S. Provisional Application No. 60/716,599 filed Sep. 13, 2005, which is fully incorporated herein by reference.

BACKGROUND

The invention relates to a centrifugal compressor. More particularly, the invention relates to a volute for use in a centrifugal compressor.

Compressors are used throughout industry to compress fluids that are generally in a gaseous or vapor state. The most common types of compressors include reciprocating compressors, rotary compressors (e.g., screw, gear, scroll, etc.), and centrifugal compressors. Centrifugal compressors are generally used when a high volume of compressed fluid, such as air is required.

Centrifugal compressors employ a rapidly rotating impeller that includes a plurality of aerodynamic features commonly referred to as blades, vanes, fins, etc. The blades interact with the fluid being compressed to accelerate the fluid. The fluid is then discharged from the impeller at a high-velocity.

The high-velocity fluid enters a diffuser that includes aerodynamic features that act on the high-velocity flow to reduce the velocity and increase the pressure of the fluid. A volute is positioned around the diffuser to collect fluid from a radial outlet that extends 360 degrees around the diffuser. The volute generally includes an annular collection chamber that discharges flow through a discharge passage. Inefficiencies can arise when flow continues to flow around the collection chamber rather than exit the volute.

SUMMARY

In one embodiment, the invention provides a volute for use in a centrifugal compressor that includes an impeller. The volute includes a housing defining a central aperture, an inlet channel and a fluid collecting channel. The central aperture is adapted to receive the impeller such that the impeller discharges a fluid to the inlet channel. The inlet channel directs the flow to the collecting channel. A discharge portion is coupled to the housing and includes a discharge passage in fluid communication with the collecting channel to discharge the fluid. A tongue portion is disposed between the collecting channel and the discharge portion. The tongue is operable to separate the fluid into a first flow that flows through the collecting channel and a second flow that flows through the discharge passage.

In another embodiment, the invention provides a volute for use in a centrifugal compressor that includes a diffuser. The volute includes a first housing portion and a second housing portion coupled to the first housing portion to define an inlet channel and a fluid collecting channel. The fluid collecting channel has a first cross-sectional area at a first angular position and a second cross-sectional area at a second angular position. The cross-sectional area increases non-linearly between the first angular position and the second angular position. A discharge portion is coupled to the housing and includes a discharge passage in fluid communication with the collecting channel.

In another embodiment, the invention provides a volute for use in a centrifugal compressor. The volute includes a housing that defines a central aperture, an inlet channel, and a fluid collecting channel. The housing is adapted to receive the diffuser within the central aperture and to receive a discharge fluid at the inlet channel. The inlet channel directs the flow to the collecting channel. A discharge portion is coupled to the housing and includes a frustoconical discharge passage in fluid communication with the collecting channel to discharge the fluid. The discharge passage has an inlet and an outlet arranged such that the cross-sectional flow area increases from the inlet to the outlet.

Other aspects and embodiments of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings.

Figure 1:
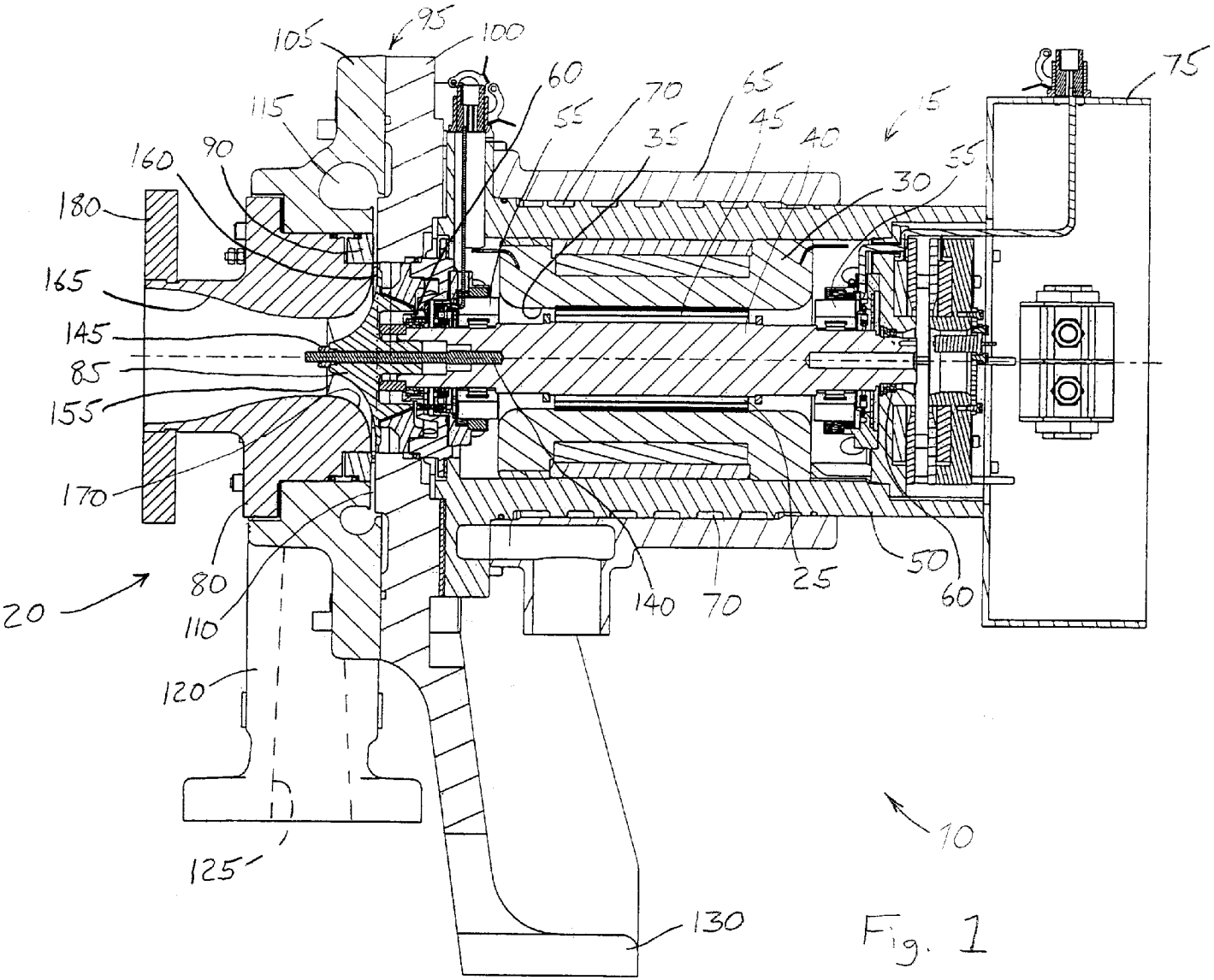
FIG. 1 is a cross-sectional view of a centrifugal compressor embodying the invention.

FIG. 1 illustrates a fluid compression system 10 that includes a prime mover, such as a motor 15 coupled to a compressor 20 and operable to produce a compressed fluid. In the illustrated construction, an electric motor 15 is employed as the prime mover. However, other constructions may employ other prime movers such as but not limited to internal combustion engines, diesel engines, combustion turbines, etc.

The electric motor 15 includes a rotor 25 and a stator 30 that defines a stator bore 35. The rotor 25 is supported for rotation on a shaft 40 and is positioned substantially within the stator bore 35. The illustrated rotor 25 includes permanent magnets 45 that interact with a magnetic field produced by the stator 30 to produce rotation of the rotor 25 and the shaft 40. The magnetic field of the stator 30 can be varied to vary the speed of rotation of the shaft 40. Of course, other constructions may employ other types of electric motors (e.g., synchronous, induction, brushed DC motors, etc.) if desired.

The motor 15 is positioned within a housing 50 which provides both support and protection for the motor 15. A bearing 55 is positioned on either end of the housing 50 and is directly or indirectly supported by the housing 50. The bearings 55 in turn support the shaft 40 for rotation. In the illustrated construction, magnetic bearings 55 are employed with other bearings (e.g., roller, ball, needle, etc.) also suitable for use. In the construction illustrated in FIG. 1, secondary bearings 60 are employed to provide shaft support in the event one or both of the magnetic hearings 55 fail.

In some constructions, an outer jacket 65 surrounds a portion of the housing 50 and defines cooling paths 70 therebetween. A liquid (e.g., glycol, refrigerant, etc.) or gas (e.g., air, carbon dioxide, etc.) coolant flows through the cooling paths 70 to cool the motor 15 during operation.

An electrical cabinet 75 may be positioned at one end of the housing 50 to enclose various items such as a motor controller, breakers, switches, and the like. The motor shaft 40 extends beyond the opposite end of the housing 50 to allow the shaft 40 to be coupled to the compressor 20.

The compressor 20 includes an intake housing 80 or intake ring, an impeller 85, a diffuser 90, and a volute 95. The volute 95 includes a first portion 100 and a second portion 105. The first portion 100 attaches to the housing 50 to couple the stationary portion of the compressor 20 to the stationary portion of the motor 15. The second portion 105 attaches to the first portion 100 to define an inlet channel 110 and a collecting channel 115. The second portion 105 also defines a discharge portion 120 that includes a discharge passage 125 that is in fluid communication with the collecting channel 115 to discharge the compressed fluid from the compressor 20.

In the illustrated construction, the first portion 100 of the volute 95 includes a leg 130 that provides support for the compressor 20 and the motor 15. In other constructions, other components are used to support the compressor 20 and the motor 15 in the horizontal position. In still other constructions, one or more legs, or other means are employed to support the motor 15 and compressor 20 in a vertical orientation or any other desired orientation.

The diffuser 90 is positioned radially inward of the collecting channel 115 such that fluid flowing from the impeller 85 must pass through the diffuser 90 before entering the volute 95. The diffuser 90 includes aerodynamic surfaces (e.g., blades, vanes, fins, etc.) arranged to reduce the flow velocity and increase the pressure of the fluid as it passes through the diffuser 90.

The impeller 85 is coupled to the rotor shaft 40 such that the impeller 85 rotates with the motor rotor 25. In the illustrated construction, a rod 140 threadably engages the shaft 40 and a nut 145 threadably engages the rod 140 to fixedly attach the impeller 85 to the shaft 40. The impeller 85 extends beyond the bearing 55 that supports the motor shaft 40 and, as such is supported in a cantilever fashion. Other constructions may employ other attachment schemes to attach the impeller 85 to the shaft 40 and other support schemes to support the impeller 85. As such, the invention should not be limited to the construction illustrated in FIG. 1. Furthermore, while the illustrated construction includes a motor 15 that is directly coupled to the impeller 85, other constructions may employ a speed increaser such as a gear box to allow the motor 15 to operate at a lower speed than the impeller 85.

The impeller 85 includes a plurality of aerodynamic surfaces or blades 150 that are arranged to define an inducer portion 155 and an exducer portion 160. The inducer portion 155 is positioned at a first end of the impeller 85 and is operable to draw fluid into the impeller 85 in a substantially axial direction. The blades 150 accelerate the fluid and direct it toward the exducer portion 160 located near the opposite end of the impeller 85. The fluid is discharged from the exducer portion 160 in at least partially radial directions that extend 360 degrees around the impeller 85.

The intake housing 80, sometimes referred to as the intake ring, is connected to the volute 95 and includes a flow passage 165 that leads to the impeller 85. Fluid to be compressed is drawn by the impeller 85 down the flow passage 165 and into the inducer portion 155 of the impeller 85. The flow passage 165 includes an impeller interface portion 170 that is positioned near the blades 150 of the impeller 85 to reduce leakage of fluid over the top of the blades 150. Thus, the impeller 85 and the intake housing 80 cooperate to define a plurality of substantially closed flow passages 175.

In the illustrated construction, the intake housing 80 also includes a flange 180 that facilitates the attachment of a pipe or other flow conducting or holding component. For example, a filter assembly could be connected to the flange 180 and employed to filter the fluid to be compressed before it is directed to the impeller 85. A pipe would lead from the filter assembly to the flange 180 to substantially seal the system after the filter and inhibit the entry of unwanted fluids or contaminates.

Figure 2:
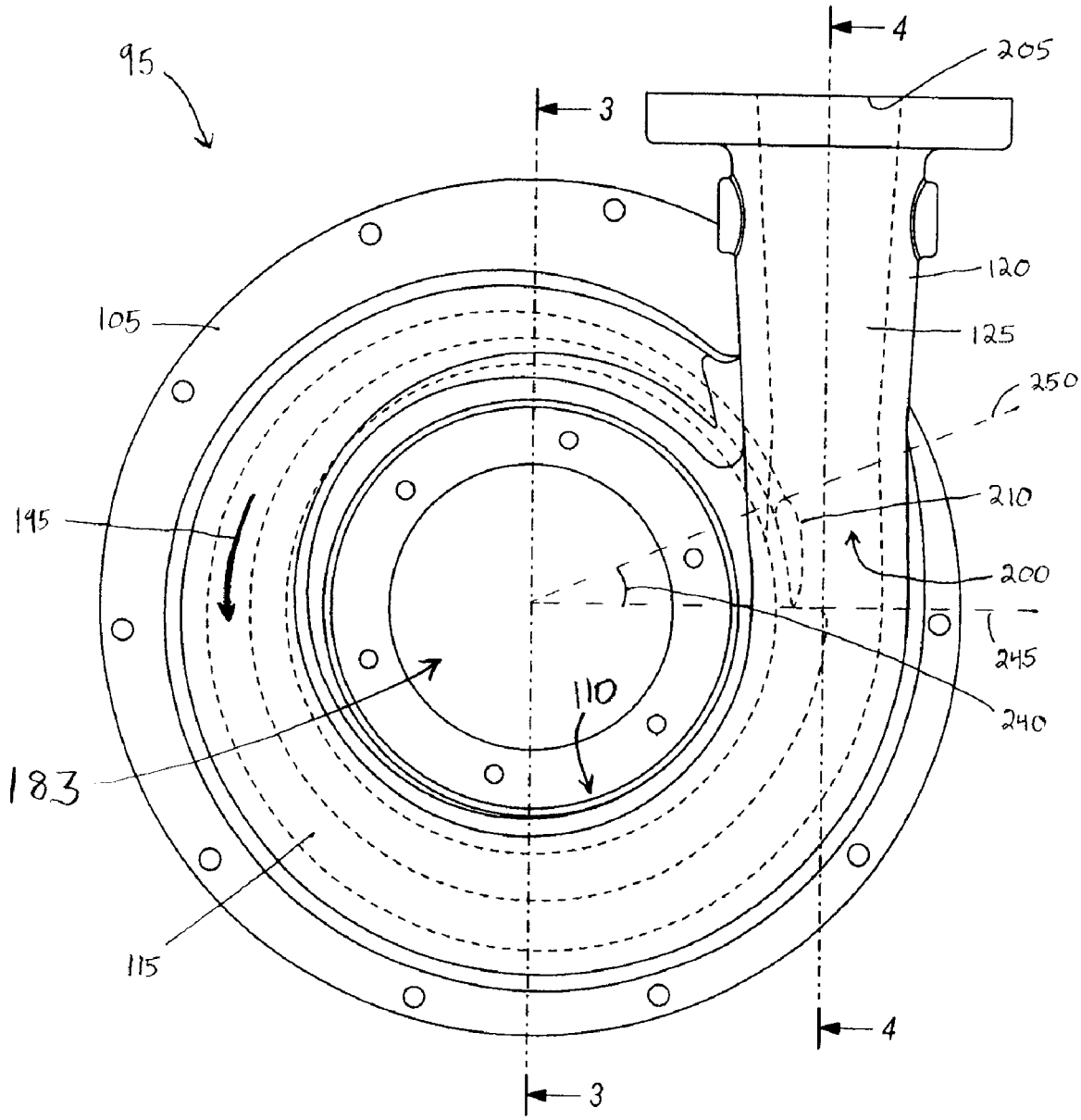
FIG. 2 is a front view of a volute of the centrifugal compressor of FIG. 1.

Turning to FIG. 2, the volute 95 is illustrated in greater detail. The volute 95 defines a space 183 that receives the impeller 85 and the diffuser 90. The inlet channel 110 radially surrounds the space 183 and is defined by the cooperation of the first portion 100 and the second portion 105. In the construction illustrated in FIG. 1, the inlet channel 110 is a narrow passageway that allows fluid flowing from the diffuser 90 to enter the collecting channel 115.

Figure 3:
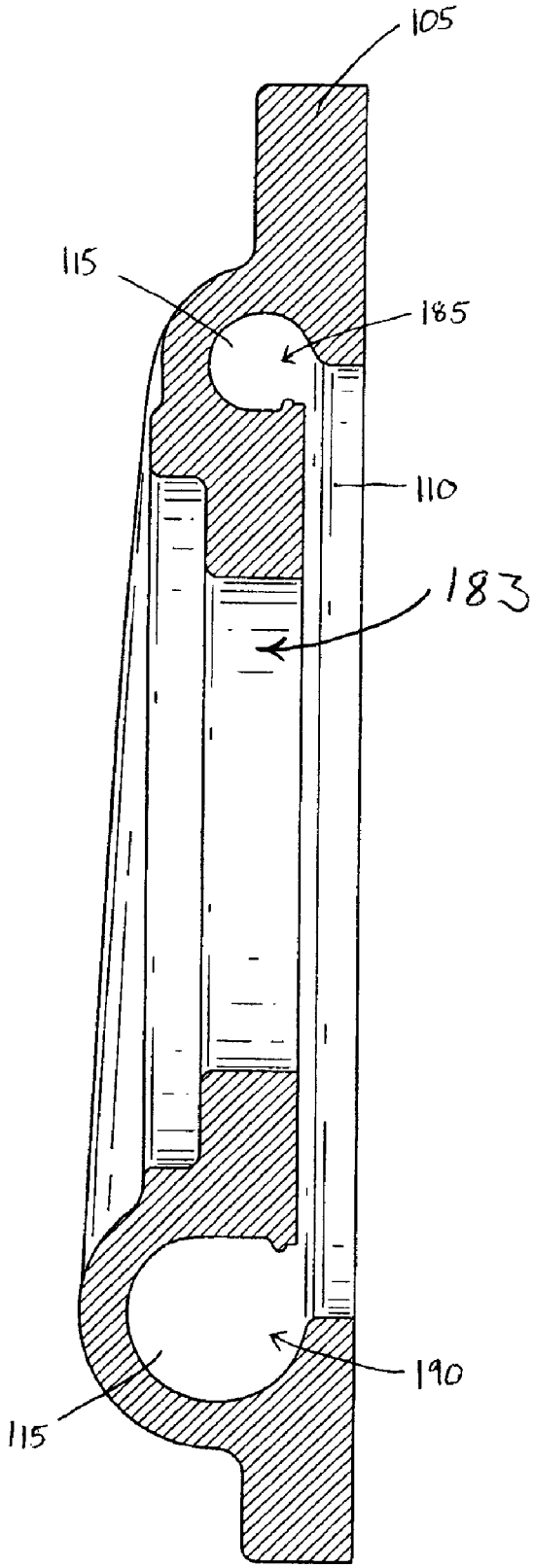
FIG. 3 is a cross-sectional view of the volute of FIG. 2 taken along line 3-3 of FIG. 2.
Figure 6:
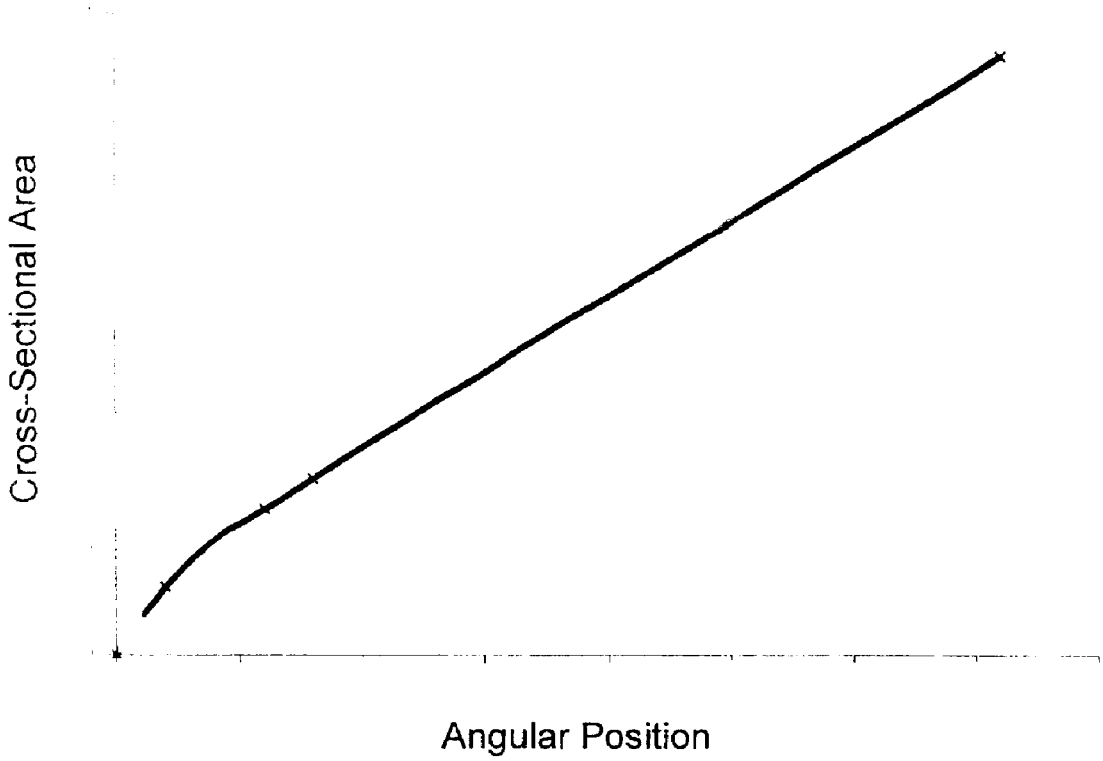
FIG. 6 is a graph showing the cross-sectional area of a collecting channel with respect to angular position.

The collecting channel 115 is substantially formed in the second portion 105 of the volute 95. The collecting channel 115 is a generally cylindrical conduit in fluid communication with the inlet channel 110 in all, or nearly all radial directions. FIG. 3 illustrates the cross-sectional area of the collecting channel 115 at a first angular position 185 and a second angular position 190. The cross-sectional area increases in a direction of fluid flow 195, shown in FIG. 2, towards the discharge portion 120. In the illustrated constructions, the change in cross-sectional area is non-linear when measured from the angular position that includes the minimum area to the angular position that includes the maximum area. FIG. 6 graphically depicts the increasing cross-sectional area of a preferred construction. In other constructions, the increase in cross-sectional area may be different than that illustrated in FIG. 6.

Figure 4:
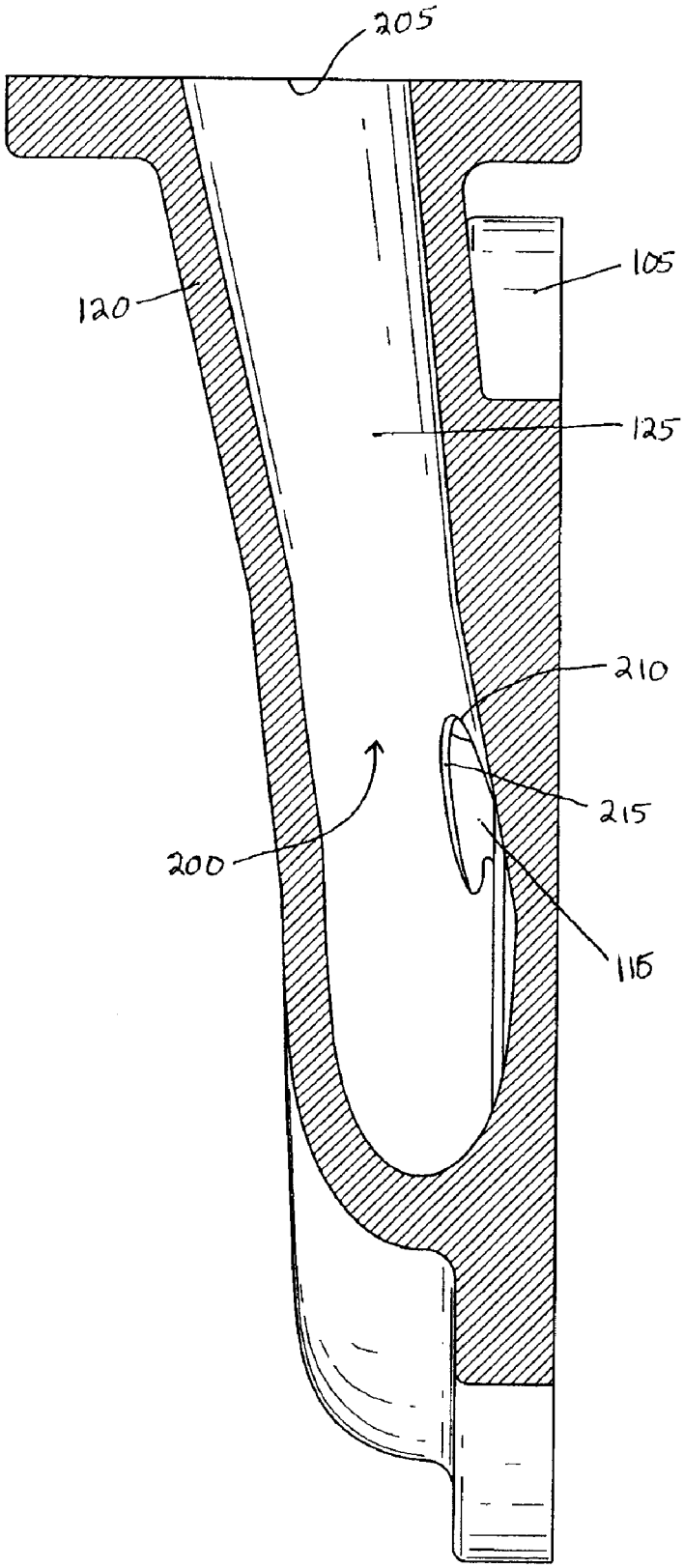
FIG. 4 is a cross-sectional view of the volute of FIG. 2 taken along line 4-4 of FIG. 2.

As illustrated in FIG. 4, the discharge portion 120 defines the discharge passage 125 including an inlet 200 and an outlet 205. The discharge portion 120 is substantially formed as part of the second portion 105 of the volute 95 such that the discharge portion 120 extends tangentially from the compressor 20. In some constructions, the discharge portion 120 may be integrally-formed with the second portion 105. In the construction of FIG. 1, the discharge portion 120 extends in the same direction as the leg 130. However, the discharge portion 120 may extend in other tangential directions, in an axial direction, or in any direction desired.

The discharge passage 125 is in fluid communication with the collecting channel 115 via the inlet 200. The outlet 205 is positioned in the discharge passage 125 on an end opposite from the inlet 200. The discharge passage 125 is frustoconical in shape such that the cross-sectional area near the inlet 200 is smaller than the cross-sectional area near the outlet 205. The increased flow area allows for additional diffusion and pressure recovery in the discharge passage 125. Fluid leaving the discharge passage 125 via the outlet 205 may flow to another device or system where the fluid can be used, stored, etc.

Figure 5:
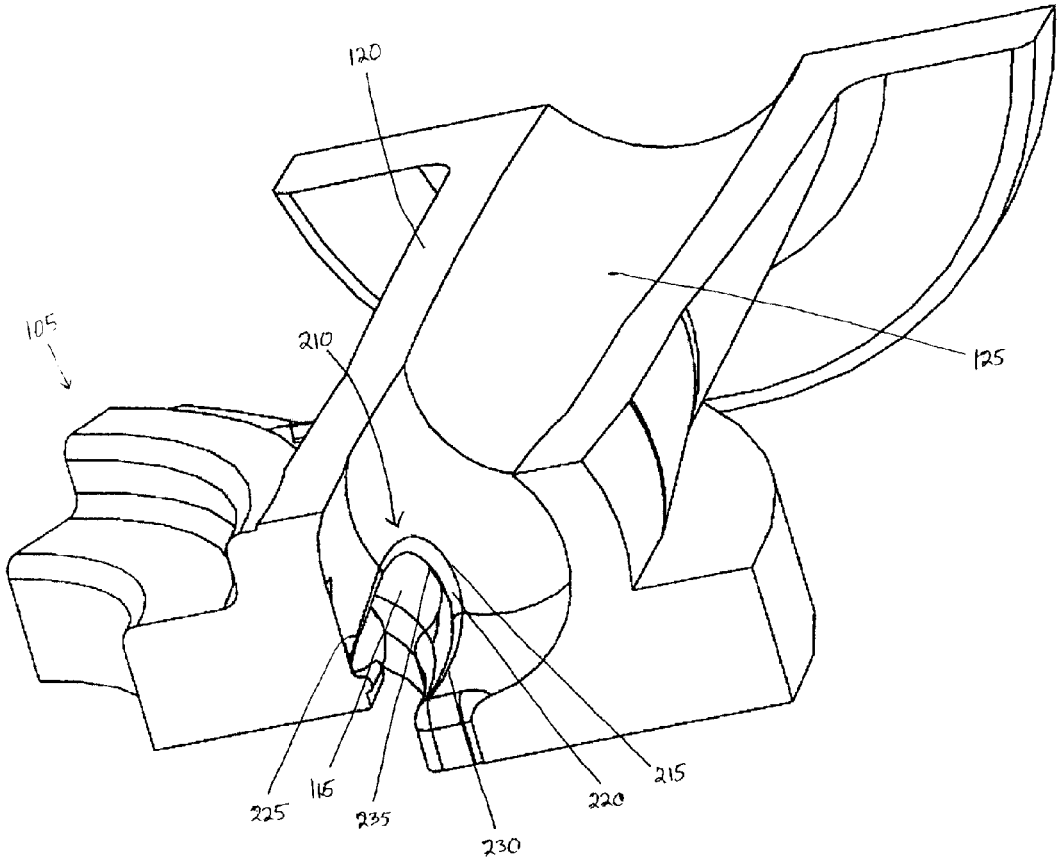
FIG. 5 is a cut-away perspective view of a tongue and a discharge passage of the volute of FIG. 2.

The volute 95 further includes a tongue 210 best illustrated in FIG. 5. The tongue 210 is disposed on the second portion 105 of the volute 95 between the collecting channel 115 and the inlet 200 of the discharge passage 125. In a preferred construction, the tongue 210 is integrally-formed as a single homogenous component with the second portion 205. In these constructions, the tongue 210 is generally machined with the second portion 105. Fluid circumferentially flowing in the collecting channel 115 is separated by the tongue 210 into a first flow that continues to flow around the collecting channel 115 and a second flow that flows to the discharge passage 125.

As illustrated in FIG. 5, the tongue 210 includes a leading edge 215 that has a fillet 220. The tongue 210 further includes a first wall portion 225, a second wall portion 230, and a central portion 235. The first wall portion 225 is situated on an end of the leading edge 215 adjacent to the discharge passage 125. The second wall portion 230 is situated on another end of the leading edge 215, opposite from the first wall portion 225, adjacent to the discharge passage 125. The central portion 235 is disposed on the leading edge 215 between the first wall portion 225 and the second wall portion 230. The tongue 210 is generally U-shaped such that the central portion 235 is positioned downstream of the first wall portion 225 and the second wall portion 230. In addition, an angle 240, shown in FIG. 2, between a first radial line 245 passing through the first and second wall portions 225 and 230 and a second radial line 250 passing through the central portion 235 is between about 15 and 30 degrees. In the construction illustrated, the angle 240 is about 25 degrees.

The fillet 220 extends from the first wall portion 225 to the second wall portion 230. The fillet 220 rounds the leading edge 215 such that the leading edge 215 is more aerodynamic in the direction of incoming fluid flow. The tapered leading edge 215 of the tongue 210 increases the efficiency of transforming high-velocity fluid to high-pressure fluid. The fillet 220 is formed such that the fillet 220 is not uniformly shaped along the entire leading edge 215. At the central portion 235 the fillet 220 has a smaller fillet radius than the radius at the wall portions 225, 230, resulting in a more narrow leading edge 215. The narrower leading edge in the central portion 235 reduces flow losses in this region, thus improving the efficiency of the volute 95.

In operation, power is provided to the motor 15 to produce rotation of the shaft 40 and the impeller 85. As the impeller 85 rotates, fluid to be compressed is drawn into the intake housing 80 and into the inducer portion 155 of the impeller 85. The impeller 85 accelerates the fluid from a velocity near zero to a high-velocity at the exducer portion 160. The fluid passes out of the impeller 85 and enters the diffuser 90. The diffuser 90 acts on the fluid to reduce the velocity. The velocity reduction converts the dynamic energy of the flow of fluid into potential energy or high-pressure. The now high-pressure fluid exits the diffuser 90 and enters the volute 95 via the inlet channel 110. The high-pressure fluid then passes into the collecting channel 115 which collects fluid from any angular position around the inlet channel 110. The high-pressure fluid circulates around the collecting channel 115 where the tongue 210 directs a portion of the high-pressure fluid into the discharge passage 125. The high-pressure fluid remaining in the collecting channel 115 re-circulates around the collecting channel 115 until the tongue 210 also directs that fluid into the discharge passage 125. The high-pressure fluid in the discharge passage 125 continues to increase in pressure due to the frustoconical shape and increasing cross-sectional area of the discharge passage 125.

This, the invention provides, among other things, a new and useful volute 95 for use in centrifugal compressors. The constructions of the volute 95 described above and illustrated in the figures are presented by way of example only and are not intended as a limitation upon the concepts and principles of the invention. Various features and advantages of the invention are set forth in the following claims.

What is claimed is:

1. A volute for use in a centrifugal compressor including an impeller, the volute comprising:

a housing defining a central aperture, an inlet channel, and a fluid collecting channel, the central aperture adapted to receive the impeller such that the impeller discharges a fluid to the inlet channel, the inlet channel directing the flow to the collecting channel;

a discharge portion coupled to the housing and including a discharge passage in fluid communication with the collecting channel to discharge the fluid; and a tongue portion disposed between the collecting portion and the discharge portion and operable to separate the fluid into a first flow that flows through the collecting channel and a second flow that flows through the discharge passage, wherein the tongue includes a leading edge that includes a fillet, and wherein the tongue defines a first wall portion and a second wall portion, and wherein the fillet defines a fillet size that varies between the first wall portion and the second wall portion.

2. The volute of claim 1, wherein the housing includes a first housing portion and a second housing portion that cooperate to define the inlet channel and the fluid collecting channel.

3. The volute of claim 2, wherein the discharge portion and the tongue portion are integrally-formed as a single piece with the second housing portion.

4. The volute of claim 1, wherein the fluid collecting channel has a first cross-sectional area at a first angular position and a second cross-sectional area at a second angular position, the cross-sectional area increasing non-linearly between the first angular position and the second angular position.

5. The volute of claim 1, wherein the discharge passage is frustoconical and wherein the cross-sectional area near an inlet is smaller than the cross-sectional area near an outlet.

6. The volute of claim 1, wherein the tongue defines a first wall portion, a second wall portion and a central portion, and wherein the tongue is shaped such that the central portion is positioned downstream of the first wall portion and the second wall portion.

7. A volute for use in a centrifugal compressor including an impeller, the volute comprising:

a housing defining a central aperture, an inlet channel, and a fluid collecting channel, the central aperture adapted to receive the impeller such that the impeller discharges a fluid to the inlet channel, the inlet channel directing the flow to the collecting channel;

a discharge portion coupled to the housing and including a discharge passage in fluid communication with the collecting channel to discharge the fluid; and a tongue portion disposed between the collecting portion and the discharge portion and operable to separate the fluid into a first flow that flows through the collecting channel and a second flow that flows through the discharge passage, wherein the tongue defines a first wall portion, a second wall portion and a central portion, and wherein the tongue is shaped such that the central portion is positioned downstream of the first wall portion and the second wall portion, and wherein the central portion is positioned to define an angle between a first radial line that passes through the first wall portion and the second wall portion, and a second radial line that passes through the central portion, wherein the angle is between about 15 degrees and 30 degrees.

8. The volute of claim 7, wherein the angle is about 25 degrees.

9. A volute for use in a centrifugal compressor, the volute comprising:

a first housing portion;

a second housing portion coupled to the first housing portion to define an inlet channel and a fluid collecting channel, the fluid collecting channel having a first cross-sectional area at a first angular position and a second cross-sectional area at a second angular position, the cross-sectional area increasing non-linearly and continuously between the first angular position and the second angular position the first angular position and the second angular position disposed at opposite ends of the collecting channel such that the first cross-sectional area is the smallest cross-sectional area and the second cross-sectional area is the largest cross-sectional area of the collecting channel; and a discharge portion coupled to the housing and including a discharge passage in fluid communication with the collecting channel.

10. The volute of claim 9, further comprising a tongue portion disposed between the housing and the discharge portion and operable to separate the fluid into a first flow that flows through the collecting channel and a second flow that flows through the discharge passage.

11. The volute of claim 10, wherein the discharge portion and the tongue portion are integrally-formed as a single piece with the second housing portion.

12. The volute of claim 10, wherein the tongue includes a leading edge that includes a fillet.

13. The volute of claim 12, wherein the tongue defines a first wall portion and a second wall portion, and wherein the fillet defines a fillet size that varies between the first wall portion and the second wall portion.

14. The volute of claim 10, wherein the tongue defines a first wall portion, a second wall portion, and a central portion, and wherein the tongue is shaped such that the central portion is positioned downstream of the first wall portion and the second wall portion.

15. The volute of claim 14, wherein the central portion is positioned to define an angle between a first radial line that passes through the first wall portion and the second wall portion, and a second radial line that passes through the central portion, wherein the angle is between about 15 degrees and 30 degrees.

16. The volute of claim 15, wherein the angle is about 25 degrees.

17. The volute of claim 9, wherein the discharge passage is frustoconical and includes an inlet and an outlet, and wherein the cross-sectional area near the inlet is smaller than the cross-sectional area near the outlet.

18. A volute for use in a centrifugal compressor including a diffuser, the volute comprising:

a housing defining a central aperture, an inlet channel, and a fluid collecting channel, the housing adapted to receive the diffuser within the central aperture and to receive a discharge fluid at the inlet channel, the inlet channel directing the flow to the collecting channel;

a discharge portion coupled to the housing and including a frustoconical discharge passage in fluid communication with the collecting channel to discharge the fluid, the discharge passage having an inlet and an outlet arranged such that the cross-sectional flow area increases from the inlet to the outlet; and a tongue portion disposed between the collecting channel and the discharge passage and operable to separate the fluid into a first flow that flows through the collecting channel and a second flow that flows through the discharge passage, wherein the discharge portion and the tongue portion are integrally-formed as a single piece with the second housing portion.

19. The volute of claim 18, wherein the housing includes a first housing portion and a second housing portion that cooperate to define the inlet channel and the fluid collecting channel.

20. The volute of claim 18, wherein the tongue defines a first wall portion, a second wall portion and a central portion, and wherein the tongue is shaped such that the central portion is positioned downstream of the first wall portion and the second wall portion.

21. The volute of claim 20, wherein the central portion is positioned to define an angle between a first radial line that passes through the first wall portion and the second wall portion, and a second radial line that passes through the central portion, wherein the angle is between about 15 degrees and 30 degrees.

22. The volute of claim 21, wherein the angle is about 25 degrees.

23. The volute of claim 18, wherein the fluid collecting channel has a first cross-sectional area at a first angular position and a second cross-sectional area at a second angular position, the cross-sectional area increasing substantially non-linearly between the first angular position and the second angular position.

24. A volute for use in a centrifugal compressor including a diffuser, the volute comprising:

a housing defining a central aperture, an inlet channel, and a fluid collecting channel, the housing adapted to receive the diffuser within the central aperture and to receive a discharge fluid at the inlet channel, the inlet channel directing the flow to the collecting channel;

a discharge portion coupled to the housing and including a frustoconical discharge passage in fluid communication with the collecting channel to discharge the fluid, the discharge passage having an inlet and an outlet arranged such that the cross-sectional flow area increases from the inlet to the outlet; and a tongue portion disposed between the collecting channel and the discharge passage and operable to separate the fluid into a first flow that flows through the collecting channel and a second flow that flows through the discharge passage, wherein the tongue includes a leading edge that includes a fillet.

25. The volute of claim 24, wherein the tongue defines a first wall portion and a second wall portion, and wherein the fillet defines a fillet size that varies between the first wall portion and the second wall portion.

* * * * *

UNITED STATES PATENT AND TRADEMARK OFFICE

CERTIFICATE OF CORRECTION

PATENT NO. : 7,604,457 B2
APPLICATION NO. : 11/531294
DATED : October 20, 2009
INVENTOR(S) : Cheng Xu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 488 days.

Signed and Sealed this

Fifth Day of October, 2010

David J. Kappos

David J. Kappos
*Director of the United States Patent and Trademark Office*